United States Patent [19]

Easter

[11] 4,068,450

[45] Jan. 17, 1978

[54] CONTAINER CAPPING MACHINE

[75] Inventor: William M. Easter, Pittsburgh, Pa.

[73] Assignee: Horix Manufacturing Company, McKees Rocks, Pa.

[21] Appl. No.: 742,416

[22] Filed: Nov. 17, 1976

[51] Int. Cl.[2] ..... B65B 7/28; B67B 3/08; B67B 3/20

[52] U.S. Cl. ..... 53/331.5; 53/367; 198/343; 198/676

[58] Field of Search ..... 53/331.5, 317, 367, 53/306, 314; 198/343, 676, 339, 475

[56] References Cited

U.S. PATENT DOCUMENTS

| | | | |
|---|---|---|---|
| 2,259,748 | 10/1941 | Hullhorst | 198/676 X |
| 2,434,053 | 1/1948 | Resina | 53/306 |
| 2,961,094 | 11/1960 | Bentley | 198/343 X |

FOREIGN PATENT DOCUMENTS

| | | | |
|---|---|---|---|
| 922,340 | 3/1963 | United Kingdom | 53/367 |

*Primary Examiner*—Othell M. Simpson

*Assistant Examiner*—Horace M. Culver

*Attorney, Agent, or Firm*—Brown, Murray, Flick & Peckham

[57] ABSTRACT

In a container capping machine a continuously moving horizontal conveyor is spaced below a vertically reciprocable rotary chuck for holding a screw cap in its lower end. Extending along one side of the conveyor is a continuously rotating horizontal positioning screw provided with a helical trough between the screw flights for receiving containers on the conveyor and controlling their forward movement through the machine. The portion of the trough beside the chuck has side walls extending partway around the screw for engaging opposite sides of a container in the trough, and these side walls are disposed in radial planes of the screw in order to stop temporarily the forward movement of a container when it reaches correct position for receiving a cap from the chuck. The container is held momentarily by gripping means while the cap is being applied to it.

1 Claim, 4 Drawing Figures

CONTAINER CAPPING MACHINE

In U.S. Pat. No. 2,434,053 a container capping machine of the same general design as the one disclosed in this application is shown. Containers, such as bottles, are carried into and out of the machine by a continuously traveling conveyor. Periodically, the bottles on the conveyor being carried into the machine are stopped by a retractable timing finger, except for the leading bottle which is carried forward to a position where a gripping mechanism engages it to hold it stationary just long enough for a vertically reciprocable rotary chuck to screw a cap onto the threaded neck of the bottle. The bottle then is released and is carried forward out of the machine. The timing of the containers into and out of the gripping mechanism relies on the friction between the container bottom and the conveyor surface supporting it, but since this friction factor is constantly changing due to the non-uniformity of the container bottoms and the cleanliness of the supporting surface of the conveyor, the timing is not uniform. The changing friction factor becomes even more of a problem for lighter weight containers and containers that are not circular in cross section.

When the containers are cylindrical, and in many cases even when they have some other shape but are made of glass so that they are rigid, the gripping mechanism usually will center them in correct position for receiving caps even when the containers have not quite reached cap-receiving position when first engaged by the gripper or have slightly passed that position before being engaged by the gripper. In other words, in such cases engagement of the gripping mechanism with the container will slide it ahead or backwards slightly on the conveyor in order to locate the container in correct position for capping. However, when the container is not cylindrical, but is rectangular for example, and especially when it is made of plastic so that it is not as rigid as glass, off-center engagement of the gripping mechanism with a container that is not quite in correct position may compress or puncture the container rather than move it into proper position. Another thing that sometimes happens is that the capped container does not move away from capping position fast enough and is caught between the gripper jaws closing on the next container.

It is among the objects of this invention to provide a container capping machine in which all containers, regardless of shape or material, are positively located in correct position for capping before being gripped by the gripping mechanism, in which each capped container is moved away from the capping zone at the proper speed, in which variations in friction between the containers and their conveyor do not affect the operation, and in which there is no need for a timing finger and its operating mechanism.

The preferred embodiment of the invention is illustrated in the accompanying drawings, in which FIG. 1 is a front view of the machine;

Figure 1:
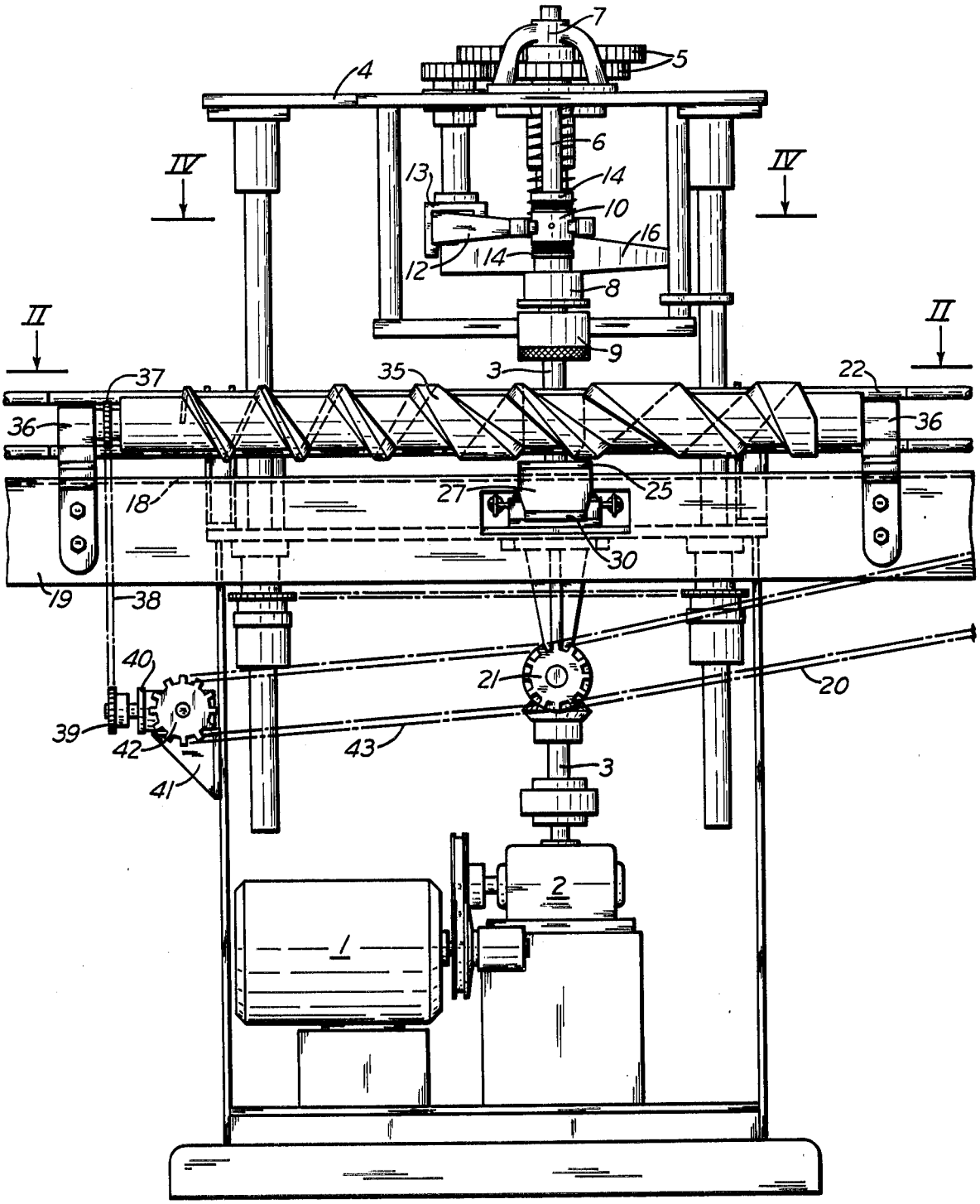

Referring to FIG. 1 of the drawings, mounted in the base of a capping machine is an electric motor 1 that drives a gear box 2, which in turn drives a vertical shaft

3 extending upwardly in the machine and up through its vertically adjustable top plate 4. This shaft, through gears 5, drives a vertical spindle 6 slidably mounted in a bearing 7 and extending down through the top plate. The spindle carries a clutch 8 on its lower end, which drives a cap-receiving chuck 9. The chuck is of well-known construction for gripping a screw cap while it is being applied to a container by means of the chuck. The way in which caps are fed to the chuck forms no part of this invention because such feeding is not new and can be done in different ways, one way being illustrated in the patent referred to above.

Figure 4:
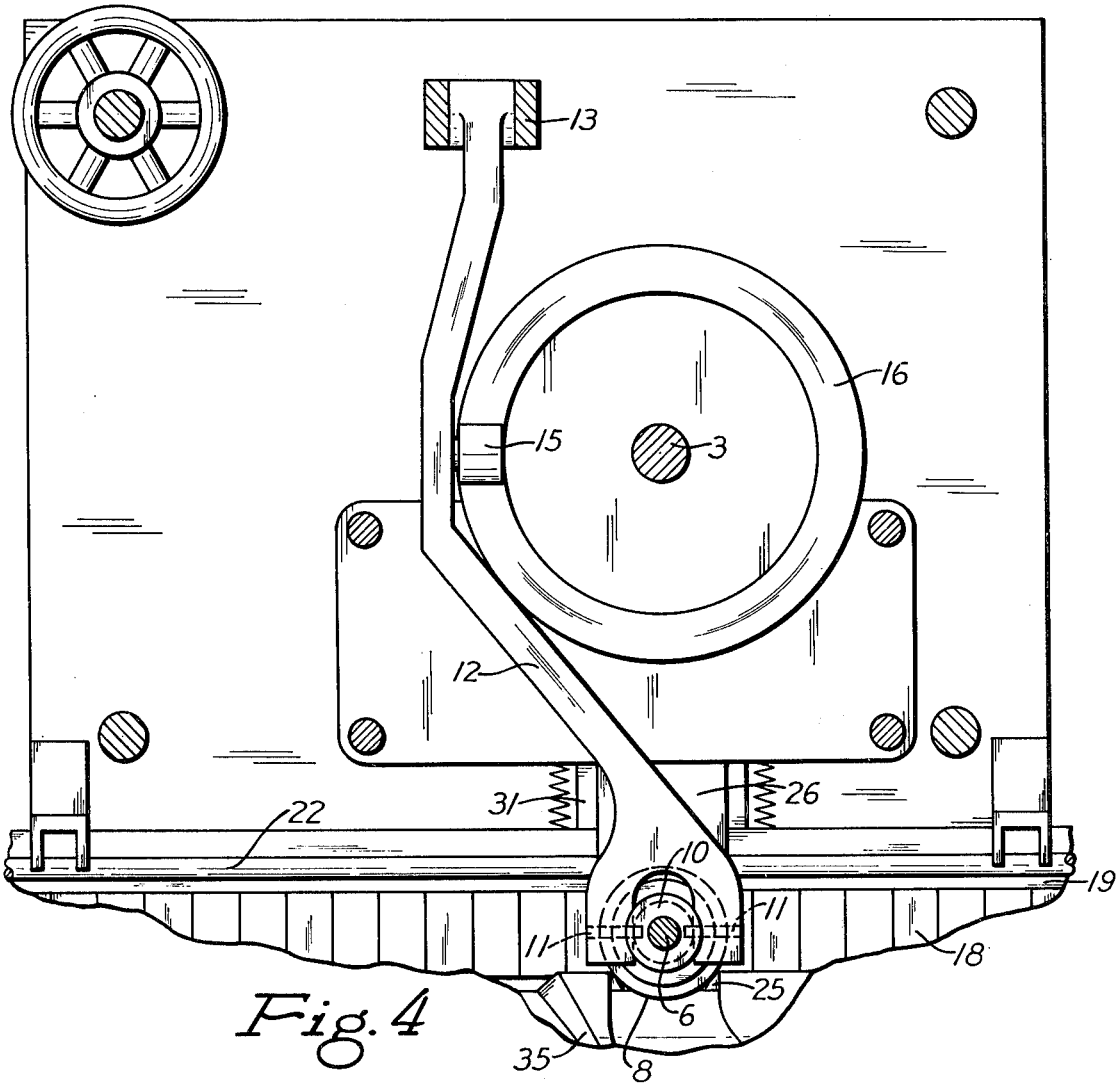
FIG. 4 is an enlarged fragmentary horizontal section taken on the line IV—IV of FIG. 1.

Above the clutch and chuck, as shown in FIGS. 1 and 4, the spindle rotates in a bushing 10 supported by axially aligned pins 11 projecting toward each other from the opposite sides of the forked front end of a lever 12 that extends back past the drive shaft 3 and has its rear end pivotally mounted on a horizontal axis in a bracket 13 extending down from top plate 4. The top and bottom of the sleeve engage bearings that also engage collars 14 rigidly mounted on the spindle. Beside the drive shaft the lever is provided with a cam follower roller 15 supported by a circular cam 16 rigidly mounted on the drive shaft. This cam is so shaped that as it rotates, it raises and lowers the front end of the lever, which in turn raises and lowers the spindle and chuck.

Figure 2:
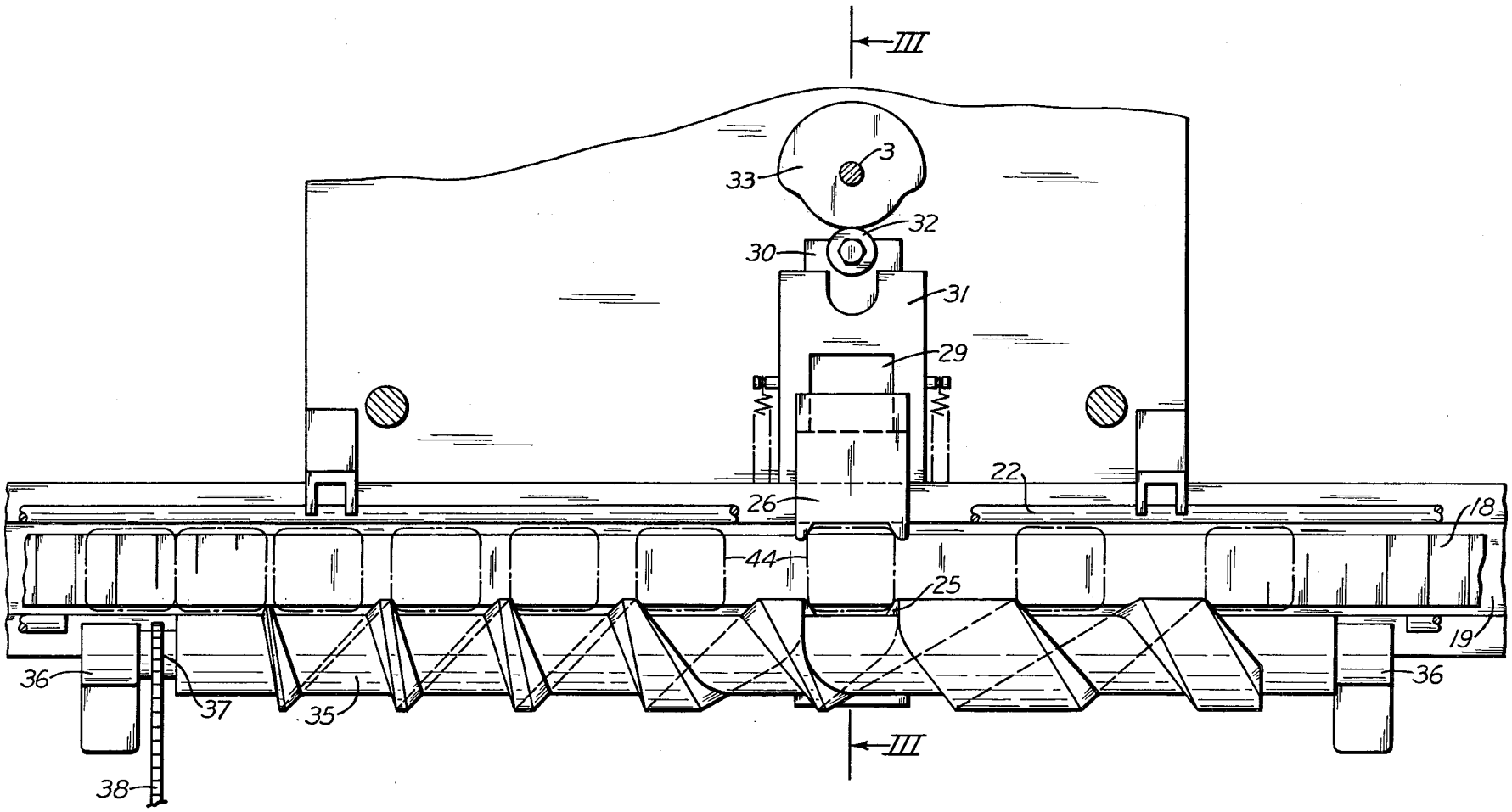
FIG. 2 is an enlarged fragmentary horizontal section taken on the line II—II of FIG. 1.
Figure 3:
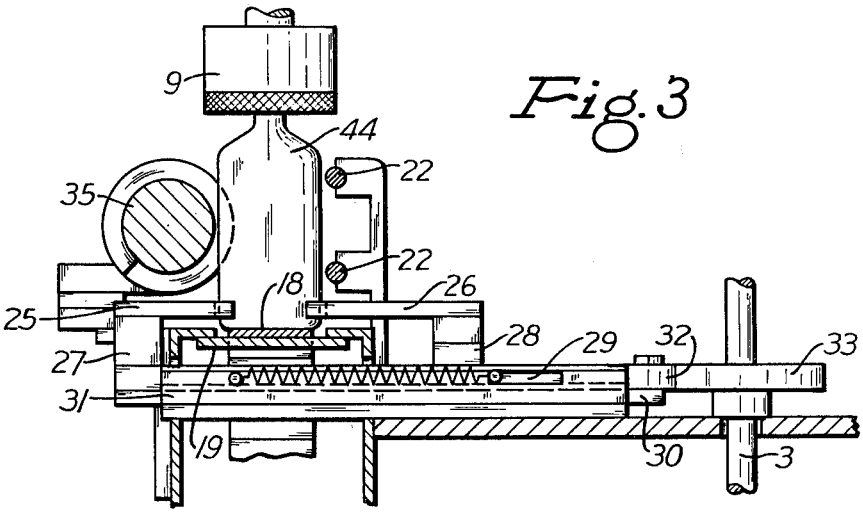
FIG. 3 is a fragmentary vertical section taken on the line III—III of FIG. 2.

Spaced directly below the cap chuck is a horizontal conveyor 18 for carrying containers through the machine, as shown in FIG. 2. This is an endless conveyor formed from narrow plates pivotally connected together like a chain. The opposite ends of the conveyor pass around sprockets (not shown) rotatably mounted in the opposite ends of a table 19, along which the upper reach of conveyor travels. The top of the conveyor is smooth so that containers can slide on it. At one end of the conveyor there is a drive sprocket (not shown) connected by a chain 20 to a sprocket 21 driven off drive shaft 3 below the table. Extending along one side of the conveyor are rails 22 that are supported by the table and against which the sides of containers, can slide.

Directly below the cap chuck there is a gripping mechanism for holding each successive container stationary while a cap is applied to it. This mechanism, the details of which form no part of this invention, includes a pair of opposite jaws 25 and 26 that move toward and away from each other across the top of the conveyor. They are timed to grip a container between them just before the chuck is lowered to screw a cap on it, and to release the container immediately after the chuck has been raised above the cap, so that the container can be moved forward again and away from the machine. The jaws are mounted on blocks 27 and 28 attached to superimposed plates 29 and 30. The upper plate is urged forward by coil springs attached at their rear ends to it and at their front ends to the stationary guides 31 for the plates. Longitudinal movement of this plate in either direction moves the lower plate in the opposite direction by means of a coupling device (not shown) between them. The lower plate projects from the rear end of the upper plate and supports a cam follower roller 32 that engages a cam 33 rigidly mounted on the drive shaft. When the cam moves the lower plate forward, the latter, through the coupling device just mentioned, moves the upper plate rearwardly so that the two jaws move away from each other.

It is a feature of this invention that before the gripping mechanism engages a container beneath the chuck, the container is correctly positioned lengthwise of the conveyor in cap-receiving position. The gripping mechanism will not move the container out of that position, except for possible adjustment transversely of the conveyor. To thus position the container, a timing or positioning screw 35 is disposed horizontally along the front side of the conveyor opposite to guide rails 22. This screw extends along the conveyor in opposite directions from the gripping mechanism below it and its opposite ends are rotatably mounted in bearings 36 supported by table 19. The rear end of the screw carries a sprocket 37 that is driven by a chain 38 from another sprocket 39 mounted on a shaft projecting from a gear box 40 mounted on a bracket 41 secured to the machine frame. Projecting forward from the gear is another shaft that carries a sprocket 42 driven by a chain 43 from a sprocket behind sprocket 21 and likewise driven by the vertical drive shaft of the machine.

The screw is provided with a screw thread of varying width and pitch. The opposite sides of the thread form the side walls of a helical trough that likewise has varying width and pitch. The trough is wide enough to receive a portion of a container supported by the conveyor. Consequently, the forward movement through the machine of a container engaged by the screw will be controlled by the screw. Containers 44 are indicated in dotted lines in FIG. 2. Through the chain and sprocket drive for the screw, its rotation is timed with the operation of the gripping mechanism and the cap chuck. The pitch of the screw thread is such that as a container approaches the chuck the screw accelerates the speed of the container, with the container sliding forward on the conveyor until it reaches capping position and is stopped. As a container leaves the chuck after being capped, its speed is accelerated by the screw up to that of the conveyor.

An important feature of this screw is that the portion of the screw trough beside the chuck has side walls that extend part way around the screw in parallel relation. These particular side walls, instead of being helical, are disposed in radial planes of the screw; that is, in spaced parallel planes perpendicular to the axis of the screw so that a dwell is formed in the helical trough. Consequently, when a container reaches this portion of the screw, the parallel side walls of the trough stop the forward movement of the container temporarily, after which the container is moved ahead again by the screw. As soon as the container is stopped beneath the chuck, the gripper jaws move into engagement with it to center it and hold it stationary while a cap is being applied to it by the chuck. The dwell in the screw trough extends around the screw about 150°.

The position of the dwell in the screw trough is such that the container is stopped in substantially the correct position for receiving the cap so that the position of the container will not have to be adjusted lengthwise of the conveyor by the gripping jaws more than a very slight amount, if at all. As previously explained, the attempt of such jaws heretofore to center an off-center container often resulted in damaging a noncircular or plastic container. This will not occur with the present invention, in which the position of the container is controlled by the screw.

Of course, the rotation of the screw is synchronized with the movement of the gripper jaws so that the container will always be in the dwell portion of the screw trough before the jaws move toward each other. Correct positioning of the containers for gripping by the jaws not only is provided by this invention, but no timing finger and its operating mechanism are required. The screw moves the containers into and out of capping position, regardless of variations in friction between the container bottoms and the supporting conveyor. Although the gripping mechanism has been shown as operating beneath the screw, in some cases it may be desirable to grip containers above the level of the screw or even to grip them both above and below it.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A container capping machine comprising a vertically reciprocable rotary chuck for holding a screw cap in its lower end while it screws the cap onto a container below it, a continuously moving horizontal conveyor spaced below the chuck, a continuously rotating horizontal positioning screw extending along one side of the conveyor and past said chuck and provided with a helical trough in a position to receive containers on the conveyor and control their forward movement, the portion of said trough beside said chuck having side walls extending part way around the screw in radial planes of the screw to stop temporarily the forward movement of a container in the trough when it reaches a position below said chuck for receiving a cap therefrom, a pair of jaws movable toward and away from each other across the top of said conveyor, means synchronized with the rotation of said positioning screw for moving the jaws toward each other to grip a stopped container between them after it enters between said radial side walls of the screw trough, means for moving said rotary chuck down and up while said jaws are gripping a container below it in said cap-receiving position, and means for moving said jaws away from each other while a capped container is still between said radial side walls, the pitch of said screw trough being such that the screw accelerates containers as they approach said jaws and accelerates them again as they leave the jaws to bring them up to substantially the speed of said conveyor.

* * * * *